US006029973A

United States Patent [19]

Takemoto

[11] Patent Number: 6,029,973

[45] Date of Patent: Feb. 29, 2000

[54] GAME MACHINE

[75] Inventor: Takatoshi Takemoto, Tokyo, Japan

[73] Assignee: Kabushiki Kaisha Ace Denken, Japan

[21] Appl. No.: 08/945,203

[22] PCT Filed: Jan. 22, 1996

[86] PCT No.: PCT/JP96/00100

§ 371 Date: Oct. 10, 1997

§ 102(e) Date: Oct. 10, 1997

[87] PCT Pub. No.: WO96/32171

PCT Pub. Date: Oct. 17, 1996

[30] Foreign Application Priority Data

Apr. 10, 1995 [JP] Japan ..... 7-84206

[51] Int. Cl.[7] ..... A63F 7/02

[52] U.S. Cl. ..... 273/121 B; 463/13

[58] Field of Search ..... 273/121 B, 292; 463/16, 17, 18, 19, 20, 13

[56] References Cited

U.S. PATENT DOCUMENTS 5,836,819 11/1998 Ugawa ..... 273/121 B 5,904,352 5/1999 Takemoto ..... 273/121 B

FOREIGN PATENT DOCUMENTS 49-19943 2/1974 Japan .

59-100476 6/1984 Japan .

*Primary Examiner*—Jessica J. Harrison

*Attorney, Agent, or Firm*—Seed and Berry LLP

[57] ABSTRACT

A poker game is simulatively performed on a display device 34 every time a pinball enters into a special prize-winning port 42. That is, before one-unit poker game is started, an array of five cards are displayed in lateral alignment with one another with four cards placed face up and a fifth card placed face down. The opening/closing frequency or time of a variable prize-winning port 40 is changed in accordance with a prize-winning card set of the poker game. After the one unit poker game is completed, the card array of the five cards is shifted in the lateral direction by one card, and the card at one end and a new card is added and displayed face down at the other end for a subsequent poker game.

10 Claims, 7 Drawing Sheets

GAME MACHINE

TECHNICAL FIELD

The present invention relates to a game machine for varying a display content on a display device provided on the game machine console panel upon entrance of a game medium driven onto a game machine console panel into a special prize-winning port, and generating a special condition advantageous to a player when the display result after the variation meets a predetermined condition.

BACKGROUND TECHNIQUE

Now widespread as conventional game machines as described above, are pinball machines in which a pattern matching game is executed on a display device, and an opening/closing operation of a variable prize-winning port which is provided on the game machine console panel and normally closed is repeatedly performed for a predetermined time or at a predetermined frequency in accordance with the result.

In the conventional pinball machine, a game machine console panel is erectly provided at the front surface side of the main body, and normally one kind of prize-winning unit to settle the kind of the game machine and enhance the game performance is mounted substantially at the center portion of the game machine console panel. The prize-winning unit comprises an elaborate mechanism which can vary the prize-winning probability in the game machine, and in accordance with the type of the prize-winning unit thus mounted, the game machine is classified into a first type game machine (so-called fever type), a second type game machine (so-called wing type), a third type game machine (so-called right type) and a fourth game machine (so-called one shot type).

Particularly, the game machine is provided with a special prize-winning port (so-called chucker) and a display device on which such a pattern matching as described above is performed. When a game medium (pinball) enters the special prize-winning port, a pattern matching game is executed in which three patterns (for example, a set of numerals [0] to [9] or a set of patterns) are varied on the display device of the game machine console panel and the variation of each pattern is stopped at a desired stop timing like a slot machine, and it is then judged whether a combination of the patterns is coincident with a big-hit pattern (for example, three numerals of 7 are aligned [777]). If it is a big-hit pattern, the variable prize-winning port is actuated in accordance with the big-hit pattern, and the game can be played with a relatively higher probability (prize-winning probability) than in the normal case. Such a pinball game machine, is called a "fever type" machine, the first type.

In the first type game machine, the occurrence probability of a specific combination of patterns on the display device is determined on the basis of random numbers which are generated by a built-in program (normally recorded in ROM), and no player can directly alter the program or control the generation of the random numbers to take an active hand in the generation probability of a specific combination.

As a result, the extent to which a player's skill actively affects the game content is limited to only the increase of an opportunity of a pattern rotating display (i.e., the frequency of entrance of a pinball into a special prize-winning port) to thereby increase the frequency of the generation of the random numbers.

Further, when a special prize-winning condition is generated due to actuation of a variable prize-winning device (attacker), if a player plays the game according to a predetermined procedure (so-called capture way), almost any play can gain the maximum given prize without difficulty, and thus gain a large number of prize-winning pinballs although some level of skill is needed.

In such a conventional game machine, however, a player's skill on the game on which the player can take an active handle is limited to the increase of the frequency of the random number generation as described above, and thus there is a problem that the game is liable to be monotonous and it has little appeal little to players and lacks amusement.

Still further, the special prize-winning condition based on the big-hit prize-winning (so-called fever prize-winning) is not obtained unless a combination of patterns is coincident with a prize-winning pattern (for example, alignment of three numerals 7 [777]), and thus there is a problem that consumption of pinballs at a player side is severe and thus the player loses his/her pinballs quickly, so that the player cannot really enjoy the game.

The present invention has been implemented in view of the conventional problem as described above, and has an object to provide a game machine in which a pattern matching game (for example, a poker game) is performed to enhance the game performance, appeal to players and enhance the amusement.

Another object of the present invention is to provide a game machine in which in addition to a special condition of a big-hit prize-winning, middle-hit and small-hit special conditions can be generated during the progress of the game until the big-hit prize-winning is obtained, thereby suppressing the consumption of the player's pinballs and enabling the player to enjoy the game, so that the game performance is enhanced, the game appeals more to players and the amusement of the game is enhanced.

DISCLOSURE OF THE INVENTION

A game machine according to the present invention for varying a display content on a display device provided on the game machine console panel upon entrance of a pinball driven onto the game machine console panel into a special prize-winning port, and generating a special condition advantageous to a player when the display result after the variation meets a predetermined condition, is characterized by including control means for simulatively executing a one-unit poker game on the display device when a pinball driven onto the game machine console panel enters a special prize-winning port, and displaying the execution result of the game on the display device, and special condition generating means for generating a special condition advantageous to a player when the execution result of the one-unit game is coincident with any one of plural prize-winning card sets.

In the game machine thus constructed, for example, the control means displays on the display device an array of five cards aligned in the lateral direction with four cards placed face up and the fifth card placed face down before the one-unit poker game is started due to entrance of a pinball to the prize-winning port, and opens the fifth card face up before the one-unit poker game is started.

In this case, when the control means opens the fifth card face up, it is preferable that the fifth card is displayed so that it is rotated a number of times as if it is placed face up, face down, face up, face down, . . . , and the pattern thereof is varied at the time of displaying each obverse face of the card. A pattern when the card is finally placed face up is settled as the pattern of the fifth card, thereby giving a player time in which the player can expand his/her expectation of establishing of a prize-winning card set, so that the game is more exciting.

When the one-unit poker game is completed, the control means shifts the five cards in the lateral direction by one card, discards the card at one end, and adds and displays a new card at the other end with the new card placed face down. All five cards are not newly dealt every one-unit poker game, but only one card is exchanged by a new one using the shift operation, thereby obtaining such an effect that the continuity of the game can be maintained and the prize-winning card sets are liable to be established continuously.

A pinball machine according to the present invention includes an erected game machine console having at least many pins for disturbing the movement of pinballs, a special prize-winning port into which only one pinball can enter at a time, a variable prize-winning port which is usually closed and into which plural pinballs can enter at a time, and an outlet port through which pinballs which do not enter into the prize-winning port are withdrawn, means for continuously driving pinballs in accordance with manipulation by a player, means for detecting entrance of a pinball into the special prize-winning port, a display device provided on the game machine console panel, control means for simulatively executing one-unit poker game on the display device and displaying the execution result of the game on the display device when a pinball driven onto the game machine console panel enters the special prize-winning port, and special condition generating means for generating a special condition advantageous to a player when the execution result of the one-unit game is coincident with any one of plural predetermined prize-winning card sets.

In the pinball machine thus constructed, the special condition generating means releases the normally-closed variable prize-winning port at least once as the special condition advantageous to the player. The special condition generating means varies at least one of the opening/closing frequency and time of the variable prize-winning port in accordance with a prize-winning card set of the poker game.

In the pinball machine, the details of the poker game can be adopted like the game machine as described above.

According to the present invention, in the game machine using balls, special conditions advantageous to players which are different in level from one another in accordance with a prize-winning card set can be generated by executing a poker game on the display device. Further, a card array is shifted by one card every one-unit poker game , and four cards of the array are used in a subsequent one-unit poker game, whereby a prize-winning card set such as "pair", "three of a kind" or the like can be reserved over plural games, and an expectation of the establishment of an upper level prize-winning card set can be increased by a new fifth card.

Accordingly, in the progress of the game until a big-hit prize-winning is obtained, a middle-hit or small-hit prize-winning can be expected. Therefore, the consumption of player's pinballs can be suppressed, and the players can sufficiently enjoy the game.

BEST MODE OF THE PRESENT INVENTION

An embodiment according to the present invention will be described with reference to the drawings.

Figure 4:
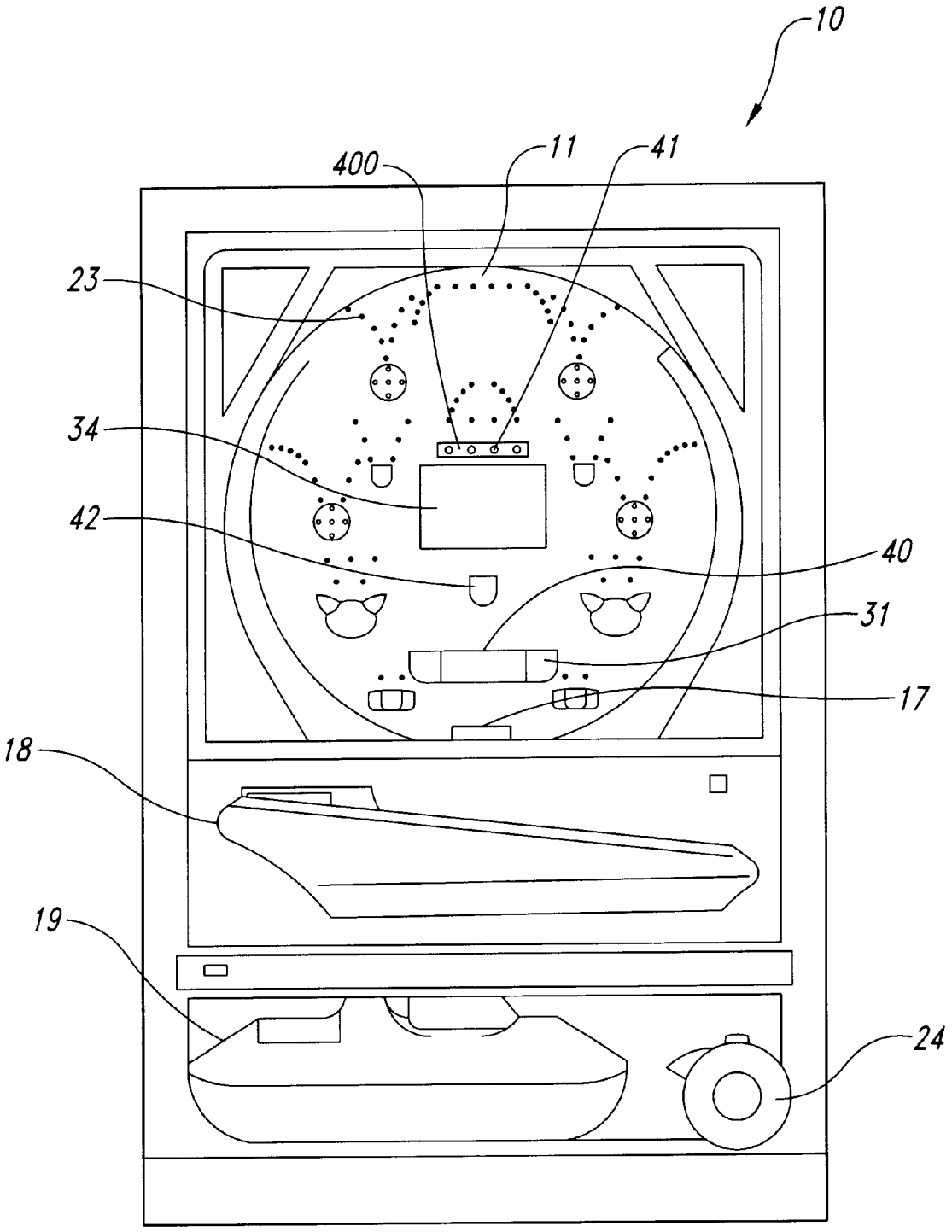
FIG. 4 is an outline view of the front panel of a pinball game machine to which the present invention is applied.

First, FIG. 4 shows the appearance of the front panel of a pinball machine to which the present invention is applied.

The game machine 10 according to this embodiment is a pinball machine in which a player rotates a handle 24 at the lower right side of the game machine at a desired angle to drive pinballs onto the game machine console panel 11 by a force corresponding to the angle and at a fixed period by a game pinball driving device (not shown), thereby aiming to gain a large number of prize-winning pinballs upon entrance of the driven pinballs into the prize-winning port as shown in FIG. 4.

The pinball machine which is exemplified as the game machine 10 is operated according to a program of a controller 50 so that one-unit poker game is performed on a display device 34 on the basis of entrance of a pinball into a specific prize-winning port 42 on the game machine console panel 11, and if the result is coincident with one of predetermined prize-winning card sets, various added values, that is, special conditions are generated through a variable prize-winning portion (a prize-winning port having a large opening). The game machine according to the present invention is applicable to not only a pinball machine, but also various game machines using balls as game medium (for example, an arrange ball machine, etc.).

Here, "one-unit poker game" means that a prize-winning card set is judged for one set of cards which are all opened.

In this embodiment, six card sets of "two-pair", "three of a kind", "straight", "flush", "full house" and "four of a kind" are prepared as prize-winning card sets of the poker game.

As shown in FIG. 4, the special prize-winning port 42 into which only one pinball can enter at a time is disposed substantially at the center portion of the game machine console panel 11. The display device 34 is disposed at the upper side of the special prize-winning port 42, and the variable prize-winning unit 40 as described later is disposed at the lower side of the special prize-winning port 42. Further, many pins 23 for repelling pinballs, various types of prize-winning members, various types of prize-winning ports, an outlet port 17, etc. are disposed at suitable places on the game machine console panel 11. The controller 50 (see FIG. 50) is secured in the body at the back side of the game machine console panel 11. At the lower side of the game machine console panel 11 are provided a front pan 18 for stocking pinballs to be supplied for the game, and a lower pan 19 for stocking pinballs which overflow from the front pan 18. The surface side of the game machine console panel 11 is covered by protection glass.

The display device 34 serves as a central prize-winning unit for performing "poker game" to generate special conditions advantageous to a player on the basis of entrance of a pinball into the special prize-winning port 42. The display device 34 may comprise an assembly of EL, LED, FIP, a display tube such as a cold cathode ray tube or the like, a liquid crystal display unit or the like. In this embodiment, an organic EL display unit is used, and thus excellent visibility can be obtained even in a bright game center. Further, when a liquid crystal display unit with a back light source is used, various kinds of color filters can be disposed on the front surface to enable a color display, and the brightness of the light source can be kept sufficient, so that more excellent visibility can be obtained even in a bright game center.

The display device 34 is set so that the display content thereof, the variation of the display content, etc. are controlled by the controller 50 as described later, and the details thereof will be described later.

Figure 5:
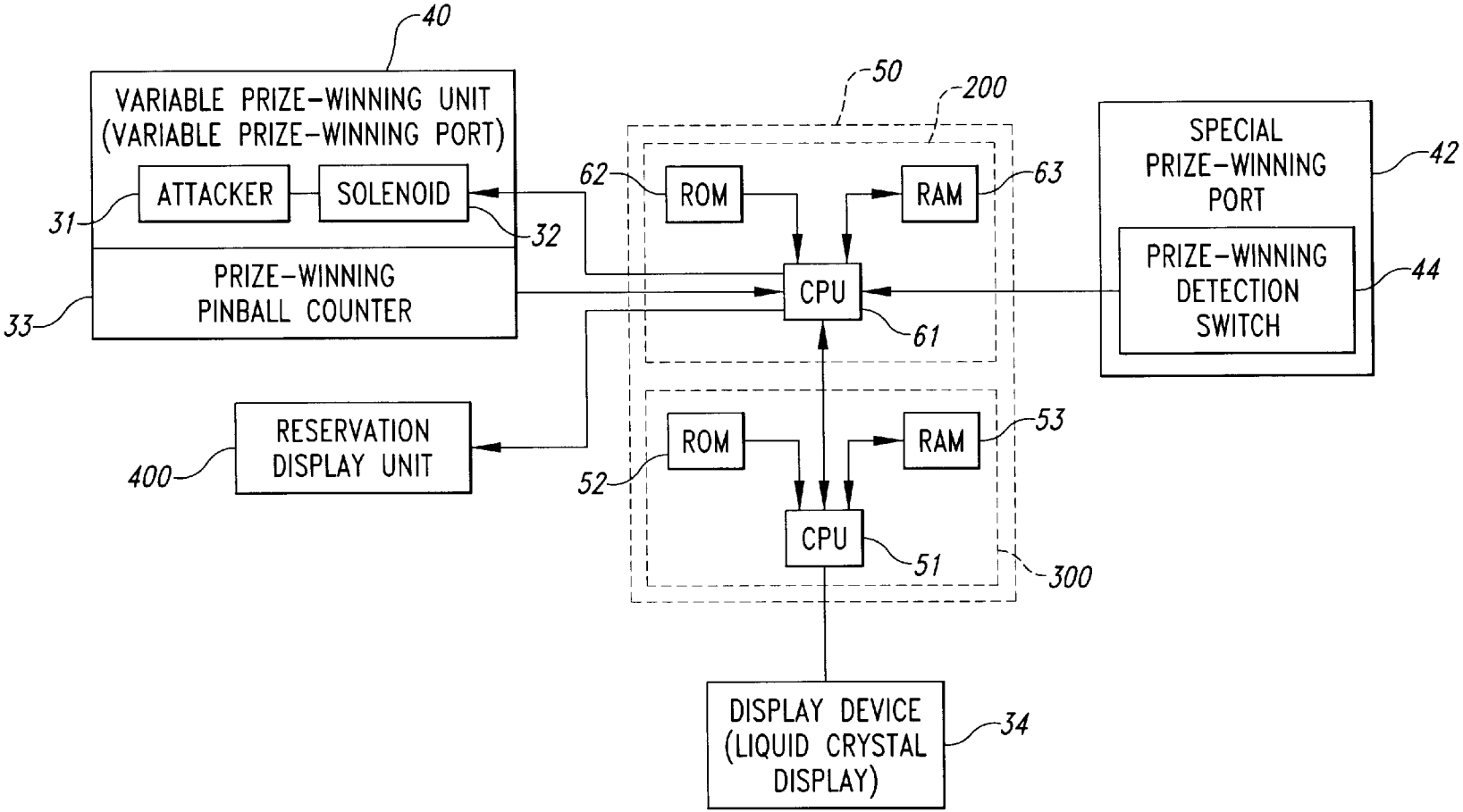
FIG. 5 is a block diagram showing the hardware construction of the game machine according to the embodiment of the present invention.

The special prize-winning port 42 is called a chucker, and it is provided with a prize-wining detection switch 44 for detecting entrance of a pinball thereto (see FIG. 5). The prize-winning detection switch 44 is connected to the controller 50, and it outputs a prize-winning signal to the controller 50 when it detects a prize-winning pinball and it is switched on. The prize-winning detection switch 44 may comprise each of various types of sensors such as an optical sensor, a contactless sensor, a magnetic sensor or the like. This embodiment uses an optical detection means using LEDs which have high resistance to external noises and are compact in size and low in power consumption. The detection output is recognized by a microprocessor as described later.

A voice generator (not shown) may be connected to the special prize-winning port 42. When a pinball enters the special prize-winning port, the voice generator of this embodiment generates music/voice and a player can hear it through a speaker.

When a predetermined condition is satisfied in one-unit game, specifically when a predetermined prize-winning card set is established, the variable prize-winning port 40 which is normally closed repeats an intermittent opening/closing operation at a predetermined frequency in accordance with the prize-winning card set. The variable prize-winning port is designed to have a sufficiently larger size than the special prize-winning port so that plural pinballs can enter the variable prize-winning port at a time, and for example, it has a rectangular opening. On the basis of the added-value judging data (special condition generating signal) 24*a* from the controller 50 as described later, the variable prize-winning port varies the opening/closing frequency or the releasing time of the attacker 31. For the highest-rank prize-winning card set, the game machine is set to a so-called fever state where the operation of opening the attacker 31 over a predetermined time (for example, 29 seconds) and then closing the attacker 31 for a short time (for example, 2 to 3 seconds) is repeated for a predetermined number of rounds (for example, 16 times).

A reservation display unit 400 is also provided on the game machine console panel 11. When pinballs newly enter the special prize-winning port 42 in the progress of the one-unit game as described above, the reservation display unit 400 displays the frequency of right reservation which is based on the entrance of the pinballs and has not been executed. The reservation display unit 400 is set to display the right reserving frequency stored in the controller 50 on the basis of the reservation display signal from the controller 50 as described above.

As shown in FIG. 4, the reservation display unit 400 specifically has four display lamps 41, 41, . . . , and the right of the one-unit game can be reserved up to four times. That is, the reservation display unit 400 is controlled so that the display lamps 41 whose number corresponds to the right reserving frequency are turned on. When the reserved one-unit game is executed, "1" is subtracted from the right reserving frequency, the controller 50 is updated and stored with the subtraction result. Further, the latest right reserving frequency is displayed on the reservation display unit 400. Further, in a state where the right is reserved at the maximum value, that is, at four times, even when a pinball enters the special prize-winning port 42, the right based on the entrance of the pinball into the special prize-winning port 42 is nullified.

Further, the inside or the periphery of the game machine console panel 11 is subjected to electrical decoration (not shown) to enhance the game performance. At the back side of the game machine console panel 11 there is disposed a shoot member for causing prize-winning pinballs to flow down onto a middle picture pan 18 while arranging the prize-winning pinballs. A prize-winning pinball counter may be provided at the downstream side of the shoot member.

FIG. 5 shows the hardware construction of the game machine according to this embodiment.

The controller 50 shown in FIG. 5 mainly includes a display controller 300 for controlling the display content of the display device 34, and a game controller 200 for controlling the operation of the variable prize-winning unit 40. The display controller 300 comprises a microcomputer including at least CPU 51, ROM 52, RAM 53, etc., and likewise the game controller 200 comprises a microcomputer including at least CPU 61, ROM 62, RAM 63, etc. The display controller 3000 and the game controller 200 are connected to each other through a bus or the like (and may contain a register (not shown)).

The display controller 300 controls the display content on the display device according to the display control program and the data which are stored in the ROM 52. The display device 34 is connected to the CPU 51. The ROM 52 stores therein fixed data such as the display control program, the data, etc. for controlling the display content of the display device 34.

The RAM 53 temporarily stores various types of data generated by the CPU 51. The pattern data are stored in the ROM 52 or a hard disc device (not shown) in a non-volatile state, and transmitted therefrom to the RAM 53. The various types of data of the RAM 53 are read out on the basis of an instruction from the CPU 62 or the CPU 51, and output to the display device 34.

Further, the CPU 61 of the game controller 200 controls the operation of the various prize-winning units containing the variable prize-winning unit 40 according to the game control program and the data which are stored in the ROM 62. The CPU 61 is connected to the prize-winning detection switch 44, the prize-winning pinball counter 33, etc. In the ROM 62 there are stored fixed data such as the game control program and the data for controlling the variable prize-winning unit 40, etc. turn-on patterns of the decorative lamps (not shown) for indicating the entrance of pinballs to the various prize-winning units, generation patterns of voices from a speaker, etc. The RAM 63 temporarily stores various types of data on the game which contain signals from the prize-winning detection switch 44 and the prize-winning pinball counter 33.

The variable prize-winning unit 40 is provided with the attacker 31 (a prize-winning device having a door which is opened and closed in the forward and backward direction)

and a solenoid 32 (see FIG. 5) serving as driving means for the attacker 31.

The reservation display unit 400 notifies a player of a right reservation state of a non-executed game. When the right of the non-executed game is reserved at the time of completion of the one-unit game, the one-unit game is sequentially executed on the display device 34 on the basis of the instruction from the controller 50. At this time, the frequency of the executed reservation right is subtractively displayed by turning out the display lamps 41 of the reservation display unit 400. As described above, when the one-unit game is in progress at the time of the entrance of a pinball to the special prize-winning port 42, the one-unit game can be reserved up to a maximum of four times. The right reservation frequency at this time is displayed by turning on the display lamps 41 of the reservation display unit 400. Even when a pinball enters the special prize-winning port 42 in a state where the right is reserved at the maximum value, that is, at four times, the right based on the entrance of the pinball is automatically nullified.

Figure 1:
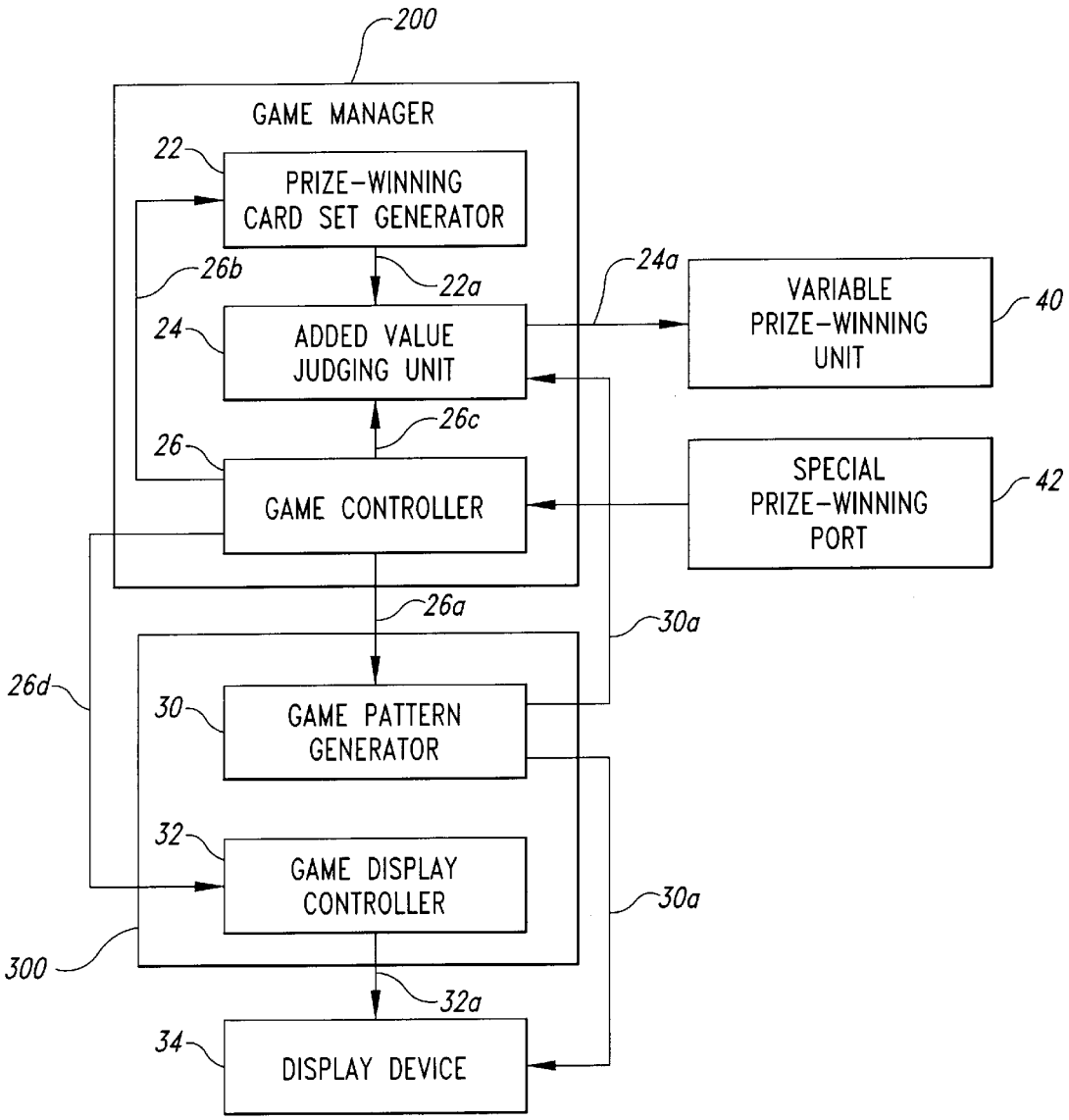
FIG. 1 is a block diagram showing the function of a game machine according to an embodiment of the present invention.

FIG. 1 is a functional block diagram showing the game machine 10 according to the embodiment of the present invention. The same elements as the other figures are represented by the same reference numerals. As is apparent from FIG. 1, the controller 50 shown in FIG. 5 contains a game manager 200 and the display controller 300.

The game manager 200 comprises a game controller 26, a prize-winning card set generator 22 and an added value judgment unit 24.

The game controller 26 generates a pattern data generating instruction 26*a* to generate game pattern data 30*a* used in the poker game, a prize-winning card set data generating instruction 26*b* for controlling the judgment of the added value of the poker game, a display request instruction 26*c* for controlling the display operation of the poker game, and an added value judgment instruction 26*c* for controlling the judgment of each added value for every prize-winning card set of the poker game.

The prize-winning card set generator 22 receives the prize-winning card set data generating instruction 26*b* to generate plural prize-winning card sets of the poker game ("two-pair", "three of a kind", "straight", "flush", "fill house", "four of a kind" in this embodiment). The prize-winning card set data 22*a* corresponding to the plural prize-winning card sets are supplied to the added value judgment unit 24, whereby the prize-winning card sets can be altered for every data or in accordance with the machine type. When a set of prize-winning card sets are fixedly used, these may be merely stored in the ROM 52 in advance.

The added value judgment unit 24 receives the added value judging instruction 26*c* to compare the game pattern data 30*a* with the prize-winning card set data 22*a* corresponding to each prize-winning card set and judge whether any one of the prize-winning card sets is established. If any prize-winning card set is established, the added value judgment data 24*a* corresponding to the prize-winning card set are generated.

The game pattern generator 30 is connected to the added value judging unit 24, the game controller 26 and the display device 34 so that upon receiving the pattern data generating instruction 26*a*, it generates the game pattern data 30*a* randomly or in accordance with the probability which is predetermined for each prize-winning card set.

The game display controller 32 is connected to the game controller 26 and the display device 34 so that upon receiving the display request instruction 26*d*, it generates the display control data 32*a* for managing the display operation of the poker game.

The display device 34 is connected to the game pattern generator 30 and the game display controller 32 so that upon receiving the display control data 32*a*, it displays the game pattern data 30*a*.

The variable prize-winning unit 40 is connected to the added value judging unit 24 so that it can alter the release time or the opening/closing frequency in accordance with the added value judging data 24*a*.

The controller of the game machine according to this embodiment is programmed to perform the following operation. That is, when "two-pair" is established, the added value judging data 24*a* are set so that the variable prize-winning unit (largely-opened prize-winning port) 40 is opened/closed twice, and when "three of a kind" is established, the added value judging data 24*a* are set so that the variable prize-winning unit 40 is opened/closed four times. Further, when a "straight" is established, the added value judging data 24*a* are set so that the variable prize-winning unit 40 is opened/closed six times, and when a "flush" is established, the added value judging data 24*a* are set so that the variable prize-winning unit 40 is opened/closed eight times. Still further, when a "full house" is established, the added value judging data 24*a* are set so that the variable prize-winning unit 40 is opened/closed ten times, and when "four of a kind" (big-hit pattern 14 in this embodiment) is established (that is, when the added value of the big-hit game (fever game) is generated), the added value judging data 24*a* are set so that the variable prize-winning unit 40 is opened/closed sixteen times.

Next, the display content of the display device 34 of this embodiment will be described.

Figure 2:
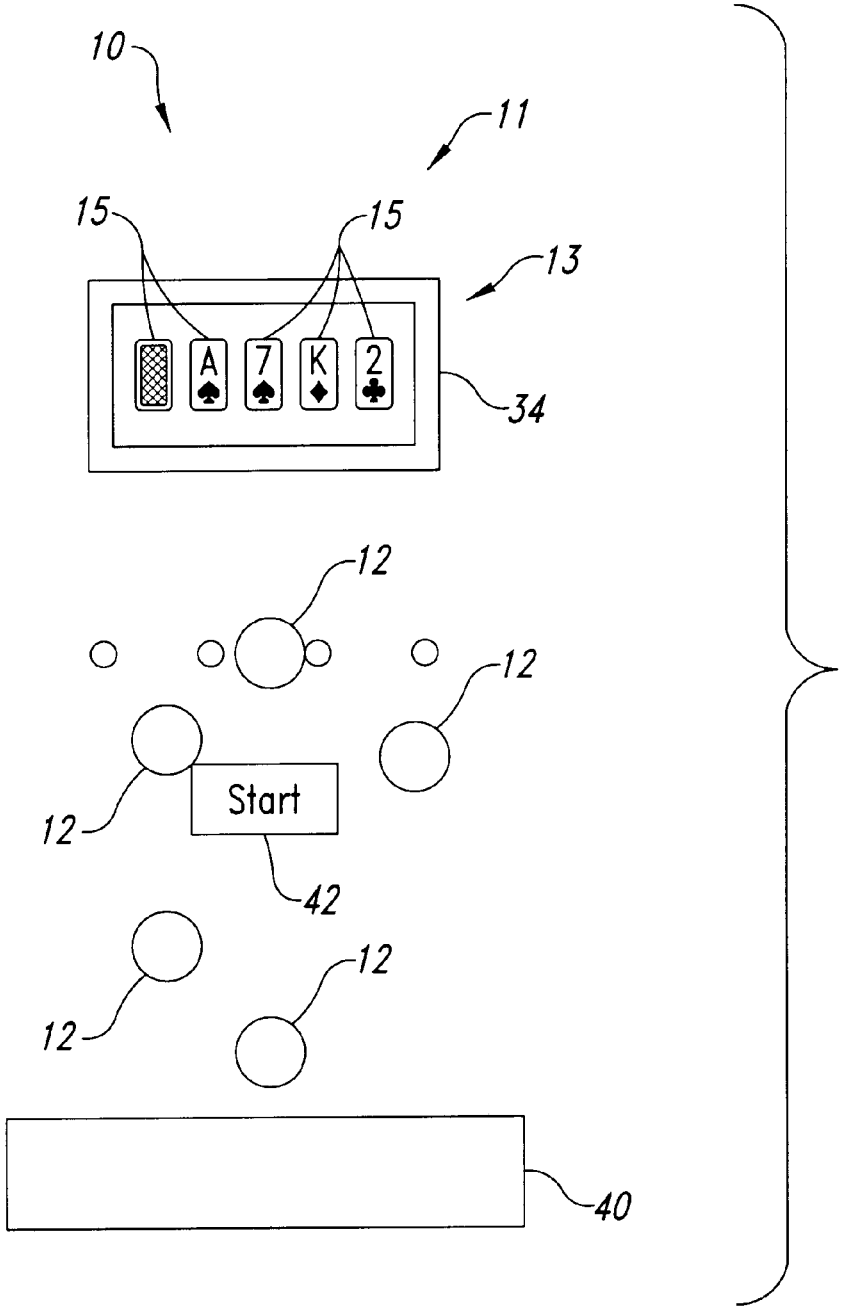
FIG. 2 is a front view of the main portion of a game machine according to the embodiment of the present invention.
Figure 3A:
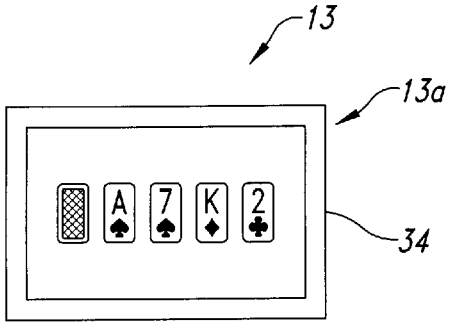
FIG. 3 is a diagram showing a game manner using a poker game according to the embodiment of the present invention.
Figure 3B:
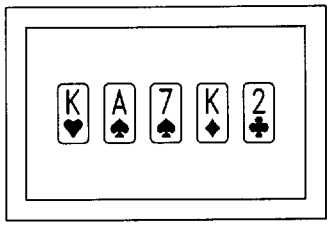
Figure 3C:
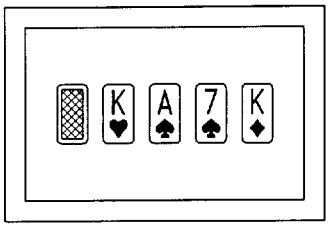
Figure 3D:
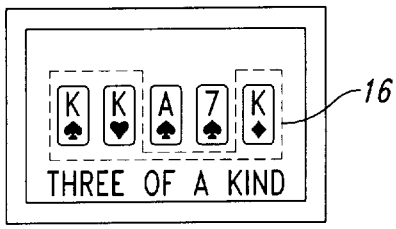
Figure 3E:
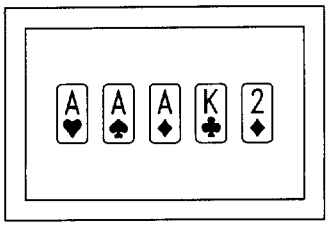
Figure 3F:
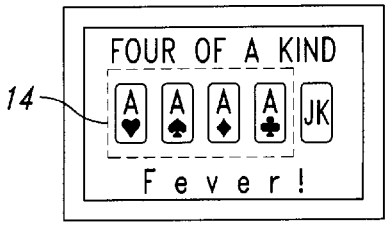

FIG. 2 is a front view showing the main part containing the display device 34 of the pinball machine 10 according to the embodiment of the present invention. The display device 34 is constructed to display the game pattern data 30*a* on the basis of the display control data 32*a*. The display device 34 displays five cards 15 on the game machine console panel 11. The display device 34 of this embodiment is constructed to display the five cards 15 in lateral alignment with one another. In FIG. 2, a card which is placed face down, a card that is the Ace of spades, a card that is the 7 of spade, a card that is the King of diamond and a card that is the 2 of club are displayed from the left side in this order.

In this embodiment, every time a pinball 12 enters the special prize-winning port 42, a new card 15 is added at the left end of a card array while placed face down. At this time, the display is made so that the card array is shifted to the right by one card, and the card at the right end is discarded.

The processing flow of the main operation of the controller 50 will be described with reference to FIGS. 6 and 7.

Figure 6:
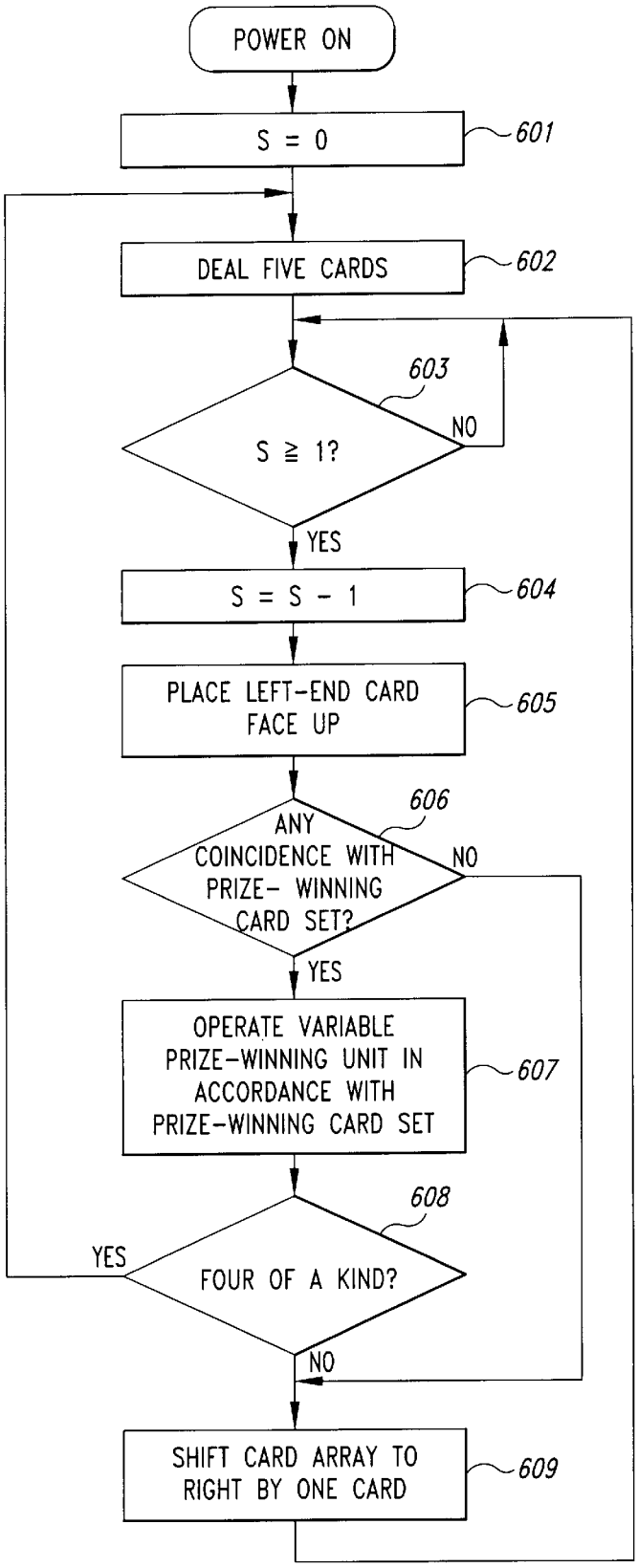
FIG. 6 is a flowchart showing the processing of the game machine of the embodiment of the present invention.

FIG. 6 shows the processing of a poker game which operates at all times after the game machine is powered on. In FIG. 6, a variable S representing the reservation frequency of the game executing right is first reset to zero (step 601). Any five cards are dealt on the display device 34 (step 602). At this time, four cards at the right side are placed face up, and the remaining one card is placed face down.

Subsequently, the value of the variable S is checked. If the value is equal to zero, the processing waits until the value is equal to 1 or more. The value of the variable S is renewed by the processing of FIG. 7 as described later in parallel to the processing of FIG. 6. If the value of the variable S is equal to 1 or more, the value is decremented (step 604), and the card at the left end is placed face up (step 605). At this time, before the pattern of this card is settled, the pattern is varied while the card is displayed so as to be rotated as if it is placed face down, face up, face down, face up, . . . Of course, the card may be merely opened, but, the above display mode can provide a more thrilling game to players.

Therefore, it is checked whether the settled pattern of the five cards is coincident with any one of the prize-winning card sets (step 606). If it is not coincident with any prize-winning card set, the processing goes to step 609 as described later.

If any prize-winning card set is established, the variable prize-winning unit 40 is opened/closed in accordance with the prize-winning card set (step 607). If this prize-winning card is the highest rank prize-winning card set "four of a kind", the processing returns to step 602 to deal new five cards.

If the prize-winning card is not the highest rank prize-winning card set, the processing goes to step 609 to shift the card array to the right by one card. At this time, the card at the right end is discarded as described above, and a new card is placed face down at the left end. Thereafter, the processing goes to step 603, and if there is a reserved right, the processing subsequent to the step 604 is performed.

Figure 7:
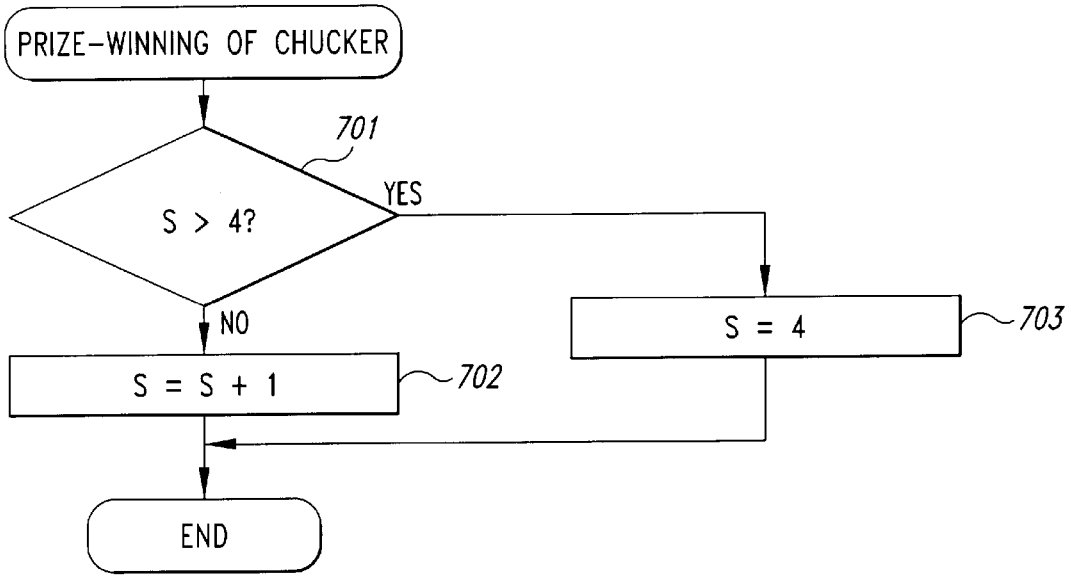
FIG. 7 is a flowchart showing processing which is executed in parallel to the processing shown in FIG. 6.

The processing of FIG. 7 is started by interrupt processing every time a pinball enters the special prize-winning port 42 (chucker prize-winning). The value of the variable S is checked every time the detection output from the prize-winning detection switch 44 is generated (step 701). If the S value is below 4, the value is incremented (step 702). If the S value is beyond 4, the value is fixed to "4" (step 703).

Next, the manner of playing the game according to this embodiment will be described with reference to FIGS. 2 and 3.

Now, it is assumed that five cards 15 are displayed in lateral alignment with one another on the display device 34 of FIG. 3(*a*) as shown in FIG. 2. As shown in FIG. 2, one-unit poker game is performed upon entrance of a pinball 12 to a start chucker (special prize-winning port) 42, and a new card 15 is dealt. The same display operation as for when a card is picked up in the poker game 13 is performed on the game machine console panel 11.

When a pinball 12 enters the start chucker (special prize-winning port) 42 to start the poker game 13 as shown in FIG. 3(*b*), the card 15 which is placed faced down at the left end is displayed as if it is rotated so to be placed face down→face up→face down→face up, . . . , and the card is updated and displayed every time the face of the card is displayed. The card displayed at the left end when the rotation is finally stopped is settled as the fifth card. In this case, the king of hearts is displayed. The card array shown in FIG. 3(*b*) is not coincident with any prize-winning card set in the state where the five cards are displayed, and thus the opening/closing operation of the variable prize-winning unit 40 is not performed.

Therefore, as shown in FIG. 3(*c*), the card array is shifted to the right and the card 15 at the right end of the card array concerned (spade 2 in FIG. 3(*b*)) is discarded. Further, a new card is placed face down at the left end of the card array. The face pattern of the card which is placed face down will be settled in the same manner as described above when a subsequent one-unit poker game is performed.

As described above, in this embodiment, the cards are displayed so that a new card is added every time one-unit poker game is executed, and the card array concerned is shifted to the right by one card, and then the card at the right end is discarded.

In the case of the card array of FIG. 3(*c*), "reach" to "three of a kind" (King of spades, King of hearts and King of another kind) which is one of the sixteen prize-winning card sets is established by the four cards at the right side. Here, "reach" means a state where a prize-winning card set would be established if one desired card completes the set.

FIGS. 3(*d*) and 3(*e*) show a state where "three of a kind" is established as a prize-winning card set of the poker game, thereby performing the opening/closing operation of the variable prize-winning unit corresponding to the "three of a kind".

As shown in FIG. 3(*f*), when a prize-winning card set of the poker game (in this embodiment, "four of a kind") is established, a player can enjoy a big-hit play (fever play). After the big-hit play is completed, all the cards are newly dealt to the player. In place of this, the card array may be shifted to the right in the same manner as described above. That is, the card 15 at the right end of the card array (diamond Jk in FIG. 3(*f*)) may be discarded and the card at the left end of the card array may be displayed face down. In this case, in the case of FIG. 3(*f*), "four of a kind" is directly established again, and the big-hit prize-winning is obtained. Further, when the card array is shifted to the right by one card, "three of a kind" or "higher rank prize-winning card set" is guaranteed. Accordingly, such a state is a special condition which is very advantageous to the player.

The kinds of the prize-winning card sets of the poker game may be limited in accordance with the type of the game machine. In a machine type in which "four of a kind" is permitted as the highest rank prize-winning card set, the opening/closing frequency or the releasing time of the variable prize-winning port may be varied in consideration of the number of prize-winning pinballs based on the establishment of at least one of "two-pair", "three of a kind", "straight", "flush", "full house" which are continuously generated in the progress of the establishment of "four of a kind". For example, if "two-pair" and "three of a kind" are established during the progress, 16 times which would otherwise be afforded by the establishment of "four of a kind" will be reduced in such a manner that 16−2−4=10 times.

As described above, according to the present invention, by executing the poker game as a pattern matching game, a game which has high game performance, powerful appeal to players and which fascinates the players can be realized.

Further, each added value is generated in accordance with a prize-winning card set of the poker game to enable alteration of the release time or the opening/closing frequency of the variable prize-winning unit, and in addition to the special condition of the big-hit prize-winning, middle-hit and small-hit prize-winning can be generated during the progress of the game until the big-hit prize-winning is obtained, so that the consumption of player's pinballs can be suppressed, and the players can sufficiently enjoy the game.

INDUSTRIAL UTILITY

The present invention is applicable to a game machine which handles pinballs as game medium, and has a display screen on the game machine console. Particularly, the present invention is more suitably applied to a pinball machine.

What is claimed is:

1. A game machine for varying a display content on a display device provided on a game machine console panel upon entrance of a pinball driven onto the game machine console panel into a special prize-winning port, and generating a special condition advantageous to a player when the display result after the variation meets a predetermined condition, characterized by including:

control means for simulatively executing one unit poker game on said display device when a pinball driven onto said game machine console panel enters a special prize-winning port, and displaying the execution result of the game on said display device; and special condition generating means for generating a special condition advantageous to a player when the execution result of the one-unit game is coincident with any one of plural prize-winning card sets; wherein said control means displays on said display device an array of five cards aligned in the lateral direction with four cards placed face up and the residual fifth card placed face down before the one-unit poker game is started due to entrance of a pinball into said prize-winning port, and opens the fifth card face up before the one-unit poker game is started.

2. The game machine as claimed in claim 1, wherein when the fifth card is opened face up, said control means displays the fifth card so that the fifth card rotates a number of times as if it is placed face up, face down, face up, face down, . . . , varies the pattern thereof at the time when each card is displayed face up, and settles as the pattern of the fifth card a pattern when the card is finally placed face up.

3. The game machine as claimed in claim 1, wherein when the one-unit poker game is completed, said control means shifts the five cards in the lateral direction by one card, discards the card at one end, and adds and displays a new card face down at the other end.

4. The game machine as claimed in claim 3, wherein when the highest rank prize-winning card set is established, five new cards are dealt with no shift.

5. A pinball machine including:

an erected pinball machine console having at least many pins for disturbing movement of pinballs, a special prize-winning port into which only one pinball can enter at a time, a variable prize-winning port which is usually closed and into which plural pinballs can enter at a time, and an outlet port through which pinballs which do not enter into said prize-winning port are withdrawn;

means for continuously driving pinballs in accordance with operation by a player;

means for detecting entrance of a pinball into said special prize-winning port;

a display device provided on said pinball machine console panel;

control means for simulatively executing one-unit poker game on said display device and displaying the execution result of the game on said display device when a pinball driven onto said pinball machine console panel enters said special prize-winning port; and special condition generating means for generating a special condition advantageous to a player when the execution result of the one-unit game is coincident with any one of plural predetermined prize-winning card sets;

wherein said special condition generating means releases said normally-closed variable prize-winning port at least once as the special condition advantageous to the player.

6. The pinball machine as claimed in claim 5, wherein said control means displays on said display device an array of five cards aligned in the lateral direction with four cards placed face up and the residual fifth card placed face down before the one-unit poker game is started due to entrance of a pinball into said prize-winning port, and opens the fifth card face up before the one-unit poker game is started.

7. The game machine as claimed in claim 6, wherein when the fifth card is opened face up, said control means displays the fifth card so that the fifth card rotates a number of times as if it is placed face up, face down, face up, face down, . . . , varies the pattern thereof when each card is displayed face up, and settles as the pattern of the fifth card a pattern when the card is finally placed face up.

8. The game machine as claimed in claim 6, wherein when the one-unit poker game is completed, said control means shifts the five cards in the lateral direction by one card, discards the card at one end, and adds and displays a new card face down at the other end.

9. The game machine as claimed in claim 8, wherein when the highest rank prize-winning card set is established, five new cards are dealt with no shift.

10. The pinball machine as claimed in claim 5, wherein said special condition generating means varies at least one of the opening/closing frequency or time of said variable prize-winning port in accordance with a prize-winning card set of the poker game.

* * * * *